US007527421B2

(12) United States Patent
Anderson et al.

(10) Patent No.: US 7,527,421 B2
(45) Date of Patent: May 5, 2009

(54) METHOD FOR TINTING A CARTRIDGE OF CAULKING MATERIAL

(75) Inventors: Dwain Robert Anderson, Edson (CA); David George Schellenberg, Spruce Grove (CA); Cindy Mae Gronlund, Niton Junction (CA)

(73) Assignee: Color Your Caulk Caulking Company Ltd., Edson (CA)

( * ) Notice: Subject to any disclaimer, the term of this patent is extended or adjusted under 35 U.S.C. 154(b) by 341 days.

(21) Appl. No.: 11/272,729

(22) Filed: Nov. 15, 2005

(65) Prior Publication Data

US 2007/0109910 A1 May 17, 2007

(30) Foreign Application Priority Data

Oct. 3, 2005 (CA) ..... 2522171

(51) Int. Cl.
*B01F 3/12* (2006.01)

(52) U.S. Cl. ..... 366/69; 366/130; 366/348; 222/221

(58) Field of Classification Search ..... 366/69, 366/96, 130, 348, 349; 206/219–222
See application file for complete search history.

(56) References Cited

U.S. PATENT DOCUMENTS 1,998,692 A 4/1935 Van Rossem et al.
2,107,851 A * 2/1938 Boehm ..... 366/130
3,195,778 A 7/1965 Coates
3,860,219 A * 1/1975 Nickerson, Jr. ..... 366/3
4,090,612 A * 5/1978 Lostutter ..... 366/92
4,114,196 A * 9/1978 Lostutter ..... 366/348
4,948,016 A 8/1990 Summons et al.
5,044,758 A * 9/1991 Kurtz ..... 366/77
5,052,554 A * 10/1991 Leonard ..... 206/219
5,301,839 A 4/1994 Eierle et al.
6,223,952 B1 5/2001 Woodford
6,464,112 B2 10/2002 Summons et al.
7,392,898 B2 * 7/2008 Bullock et al. ..... 206/221
2002/0036952 A1 * 3/2002 Anderson et al. ..... 366/348
2002/0065353 A1 5/2002 Anderson et al.

(Continued)

OTHER PUBLICATIONS

Excerpt from Red Devil website entitled "Custom Color Caulk in Minutes"—http://www.reddevil.com/colorcaulk2.cfm (1 page) 2004.

(Continued)

*Primary Examiner*—Charles E Cooley
(74) *Attorney, Agent, or Firm*—Donald V. Tomkins

(57) ABSTRACT

In a method for tinting caulking, a quantity of caulking is sealed within and toward one end of an elongate, pliable casing. The unfilled portion of the casing is then unsealed, and a quantity of tinting agent, such as paint, is introduced into the casing, which is then resealed. The caulking and tinting are then intermixed by manual kneading of the casing until the caulking has acquired a desired colour. The sealed end of the filled portion of the casing is then unsealed, the casing is inserted into a caulking cartridge with the filled portion disposed toward the nozzle end of the cartridge, and a slidable plug is inserted into the cartridge. The cartridge may is then loaded in a conventional caulking gun, which upon actuation urges the plug against the casing so as to force the tinted caulking out of the unsealed casing and through the cartridge nozzle.

6 Claims, 4 Drawing Sheets

U.S. PATENT DOCUMENTS

| | | | | |
|---|---|---|---|---|
| 2002/0154568 | A1 | 10/2002 | Renfro | |
| 2004/0173640 | A1* | 9/2004 | Brandon | 222/327 |
| 2006/0151531 | A1* | 7/2006 | Tikusis | 222/145.6 |
| 2007/0109910 | A1* | 5/2007 | Anderson et al. | 366/130 |
| 2007/0242558 | A1* | 10/2007 | Brandon | 366/143 |

OTHER PUBLICATIONS

Excerpt from Red Devil website—Press Release—http://www.red-devil.com/press1.cfm (1 page) 2005.
Red Devil, Inc., Create-A-Color Caulk Mixer Operating Instructions sheet (1 page) 2005.

* cited by examiner

METHOD FOR TINTING A CARTRIDGE OF CAULKING MATERIAL

FIELD OF THE INVENTION

The present invention relates in general to methods and systems for imparting a desired colour to caulking compounds.

BACKGROUND OF THE INVENTION

Caulking compounds are commonly used in a variety of applications in construction and renovation of residential and commercial buildings, typically as a sealant to prevent leakage or infiltration of air or moisture. In many instances the caulking will be exposed, making it desirable for the caulking to be colour-matched to adjacent surfaces such as walls, ceilings, or trim materials, so that the caulking visually blends in with the adjacent materials. In additional to these common instances, there may be other circumstances in which coloured or tinted caulking may be desirable.

Caulking is typically sold in cartridges which can be inserted into caulking guns, thus making caulking application convenient and relatively easy for contractors as well as "do-it-yourself" homeowners. However, the caulking is typically white in colour (or clear). It is not economically feasible for a caulking manufacturer to make cartridge-packed caulking available in an extensive range of colours, and certainly not so as to be able to match all the colours that can be obtained through creative tinting of paint.

For these reasons, contractor and homeowners may be faced with a problem when wishing to apply caulking that matches a painted adjacent surface (for example, when caulking around a door or window frame), because it is not possible to buy a cartridge of colour-matched caulking. One possible way to deal with this problem might be to scoop the caulking out of a cartridge, place it in a pail or other container, add a tinting agent (typically paint), and mix the tinting agent manually into the caulking using a stick or other tool. After the caulking has been mixed to a sufficiently uniform colour, it would be packed back into the cartridge. Although workable to some extent, this method would be both time-consuming and messy, particularly because of the stickiness that is inherent to caulking materials.

The prior art discloses a variety of methods and apparatus directed to mixing and tinting caulking or other cartridge-packed compositions, including the following:

- U.S. Pat. No. 1,998,692 (Van Rossem et al.), issued Apr. 23, 1935;
- U.S. Pat. No. 3,195,778 (Coates), issued Jul. 20, 1965;
- U.S. Pat. No. 4,090,612 (Lostutter), issued May 23, 1978;
- U.S. Pat. No. 4,114,196 (Lostutter), issued Sep. 12, 1978;
- U.S. patent application Ser. No. 09/452,881 (Anderson et al.), filed Dec. 2, 1999;
- U.S. patent application Ser. No. 09/976,008 (Anderson et al.), filed Oct. 15, 2001;
- U.S. patent application Ser. No. 10/115,330 (Renfro), filed Apr. 2, 2002; and
- U.S. patent application Ser. No. 10/382,648 (Brandon), filed Mar. 7, 2003.

A characteristic common to all of these prior art inventions is that they involve the use of mechanical apparatus of some form. In some cases, mixing is effected by manipulating of a mixing tool that comes into direct physical contact with the materials being mixed (e.g., caulking and tinting agent). In other cases, the materials to be mixed are loaded into cartridges which are then mounted on a machine that agitates the cartridges, thereby mixing the materials contained therein.

These prior art inventions have a number of drawbacks and disadvantages. The use of apparatus having a mixing tool entails post-use clean-up, which once again is time-consuming and messy. The prior art inventions that mix the material by agitation of loaded caulking cartridges are intended for mixing multiple cartridges, whereas contractors or homeowners will commonly require only one cartridge (or less) of coloured caulking. In addition, the use of agitation-type mixing apparatus may require the introduction of plasticizers and/or a heating step to lower the viscosity of the caulking in order to facilitate satisfactory mixing. A further and basic disadvantage common to all of these prior art inventions is the fact that they involve some type of mechanical apparatus, with associated cost and maintenance requirements.

For the foregoing reasons, there is a need for a method and system for tinting caulking by mixing the caulking with a tinting agent, but without the need for mechanical mixing apparatus. There is a further need for such method and system that facilitates tinting of caulking in quantities small enough for use in a conventional caulking cartridge. In addition, there is a need for such method and system whereby caulking can be tinted without the user coming into direct physical contact with the caulking or the tinting agent. The present invention is directed to these needs.

BRIEF DESCRIPTION OF THE INVENTION

In general terms, the present invention is a method for tinting caulking, and a caulking product system for use in association with the method. In accordance with the invention, a caulking charge (i.e., a desired quantity of caulking) is provided within an elongate, pliable casing, at least a portion of which is substantially transparent so that the colour of the caulking inside the casing can be viewed. Preferably, the casing is completely transparent (such as by using a casing made from clear plastic film).

The casing is sealed at both ends, so as to inhibit drying or curing of the caulking. The casing is longer than needed to hold the caulking charge, and the caulking charge is disposed toward one end of the casing. This results in the casing being effectively divided into a filled portion and a substantially empty unfilled portion. The length of the unfilled portion is generally not critical except that it must be sufficient so that:

- the end of the unfilled portion can be unsealed (such as by simply cutting off the end of the unfilled portion with a knife or scissors, or by making a small slit or puncture in the unfilled portion, or by any other suitable means);
- a tinting charge (i.e., a desired quantity of tinting agent) can then be introduced into the casing through the unsealed end of the unfilled portion; and
- the end of the unfilled portion can then be resealed, so as to enclose the caulking charge and the tinting charge.

In the preferred embodiment, the unfilled portion of the casing is long enough to permit effective resealing by simply tying a knot in the unfilled portion. However, other ways of resealing the end of the unfilled portion may be used without departing from the invention. The point of resealing (e.g., the knot location) will preferably be fairly close to the caulking charge, but this is not essential to the invention. In some situations it may be desirable to leave some space between the point of resealing and the caulking charge, and perhaps to include an air space, to facilitate mixing of the caulking charge and tinting charge in accordance with the method of the invention, as described below.

Once the end of the unfilled portion of the casing has been resealed, the caulking charge and tinting charge are intermixed by manual manipulation of the casing, such as by kneading, rolling, squeezing, or other suitable manual technique, or a combination of such manual techniques. When the caulking and tinting agent have been sufficiently intermixed, such that the caulking has acquired a desired colour, the caulking is ready for use. The sealed end of the filled portion of the casing may then be unsealed (such as by slitting with a knife), whereupon the casing is inserted into a conventional cylindrical caulking cartridge with the filled portion disposed toward the nozzle end of the cartridge. A slidable plug member is then inserted into the cartridge, which is now ready for loading into a conventional caulking gun.

Accordingly, in one aspect the present invention is a method for tinting caulking, comprising the steps of: providing a quantity of caulking sealingly enclosed in and partially filling an elongate, pliable casing, at least a portion of said casing being transparent; unsealing one end of the casing; introducing a quantity of tinting agent into the casing, said tinting agent being miscible with the caulking; resealing the unsealed end of the casing; and kneading the caulking and tinting agent within the casing until the caulking is of a substantially uniformly colour.

In another aspect, the invention is a method for preparing a cartridge of tinted caulking, said method comprising the steps of: providing an elongate cylindrical cartridge having a nozzle end, an open end, and an interior chamber with a cylindrical wall; providing a quantity of caulking sealingly enclosed in and partially filling an elongate, pliable casing, at least a portion of said casing being transparent; providing a plug member having a circular perimeter edge, said plug member being movable longitudinally within the interior chamber of the cartridge with said perimeter edge in sliding engagement with the cylindrical wall of the cartridge; unsealing one end of the casing; introducing a quantity of tinting agent into the casing, said tinting agent being miscible with the caulking; resealing the unsealed end of the casing; kneading the caulking and tinting agent within the casing until the caulking is of a substantially uniformly colour; unsealing one end of the casing, and inserting the casing, unsealed end first, into the open end of the cartridge; and inserting the plug member into the open end of the cartridge.

In preferred embodiments of the method, the caulking is a latex-based caulking and the tinting agent is a latex-based paint. However, other types and combinations of caulking and tinting agent may be used without departing from the present invention provided that the tinting agent is miscible with the caulking. For example, the method could be used to tint an oil-based caulking using an oil-based (i.e., alkyd) paint as the tinting agent.

For purposes of this patent document, the term "miscible", with reference to a tinting agent for tinting caulking in accordance with the method of the invention, denotes that the tinting agent may be substantially uniformly combined with the caulking without separation. The tinting agent will preferably be in liquid form, such as a paint, but tinting agents in powdered or other forms may be used without departing from the invention, provided that they have suitable miscibility for the type of caulking being used.

In a further aspect, the invention is a caulking product comprising: an elongate cylindrical cartridge having a nozzle end, an open end, and an interior chamber with a cylindrical wall; a quantity of caulking sealingly enclosed in an elongate, pliable casing, at least a portion of said casing being transparent, wherein the caulking fills only part of the casing and is disposed toward one end thereof, thus dividing the casing into a filled portion and an unfilled portion, and said casing being disposed within the interior chamber of the cartridge; a plug member closing off the open end of the cartridge so as to retain the casing within the interior chamber of the cartridge. In the preferred embodiment, the plug member includes a gripping element to facilitate removal of the plug member from the cartridge. Also in the preferred embodiment, the caulking product of this aspect of the invention includes means for introducing a tinting agent into the casing (for example, a syringe).

In a yet further aspect, the invention is a caulking product comprising: a quantity of caulking sealingly enclosed in an elongate pliable casing, at least a portion of said casing being transparent, wherein the caulking fills only part of the casing and is disposed toward one end thereof, thus dividing the casing into a filled portion and an unfilled portion.

BRIEF DESCRIPTION OF THE DRAWINGS

Embodiments of the invention will now be described with reference to the accompanying figures, in which numerical references denote like parts, and in which.

DETAILED DESCRIPTION OF THE PREFERRED EMBODIMENT

Figure 1:
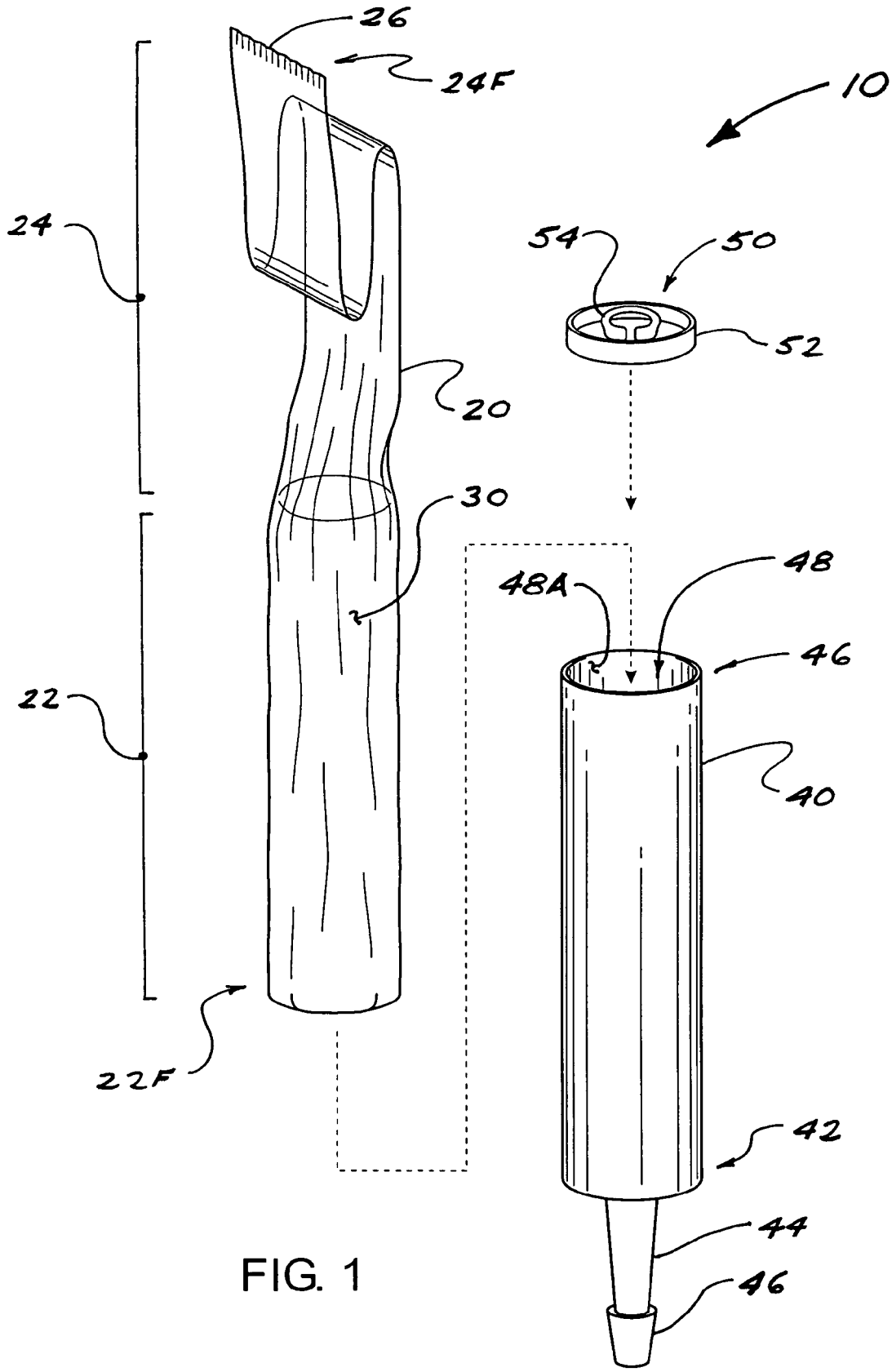
FIG. 1 is an exploded view of the components of a caulking product in accordance with one embodiment of the invention.

FIG. 1 illustrates the components of a caulking product (generally designated by reference numeral 10) in accordance with a preferred embodiment of the invention. An elongate pliable casing 20 is partially filled with caulking 30, with said caulking 30 being disposed toward one end of the casing 20, which is thus effectively divided into a filled portion 22 (having a free end 22F) and an unfilled portion 24 (having a free end 24F). Caulking 30 is preferably densely packed into filled portion 22 so as to form a sausage-like shape; however, this is not essential to the invention. It is known to form sealed caulking "sausages" (see, for example, U.S. Pat. No. 5,301,839, issued to Eierle et al. on Apr. 12, 1994), but the provision of an unfilled portion 24 particularly distinguishes the partially-filled casing 20 of the present invention from such prior art. For reasons that will be explained, it may be desirable for unfilled portion 24 to be at least a few inches long, but this is not essential. What is important is that the unfilled portion 24 is large enough to allow for introduction of a desired quantity of tinting agent into the casing 20 (after it has been unsealed, as described below), while allowing for casing 20 to then be resealed.

Free ends 22F and 24F are sealed in substantially vapour-tight fashion to prevent drying or curing of caulking 30 inside casing 20. The sealing of free ends 22F and 24F may be accomplished by any of a variety of suitable known means, as will be readily evident to persons skilled in the field of the invention. For example, free ends 22F and 24F may be heat-sealed or crimp-sealed as conceptually denoted by reference numeral 26 in FIG. 1. In preferred embodiments, casing 20 is made from a clear plastic film (e.g., polyethylene), which is readily available in continuous rolls in "bag" form (i.e., such that a sealed pocket can be formed by transversely sealing the material at two longitudinally-spaced locations.

The caulking product 10 of FIG. 1 also includes a conventional cylindrical caulking cartridge 40 having a nozzle end 42, a nozzle 44 (preferably with nozzle cap 44A), an open end 46, and an interior chamber 48 with a cylindrical wall 48A. Cartridge 40 is proportioned and adapted such that caulking-filled casing 20 may be readily received within interior chamber 48. In the preferred embodiment, the cross-sectional diameter of interior chamber 48 will be only slightly larger than the diameter of the filled portion 22 of casing 20 when filled portion 22 is densely packed into a sausage-like configuration as previously described.

Included as well in this embodiment of caulking product 10 is a plug member 50 having a circular perimeter edge 52. Plug member 50 is proportioned so as to be movable longitudinally within the interior chamber 48 of cartridge 40, with its perimeter edge 52 in sliding engagement with cylindrical wall 48A.

Figure 2:
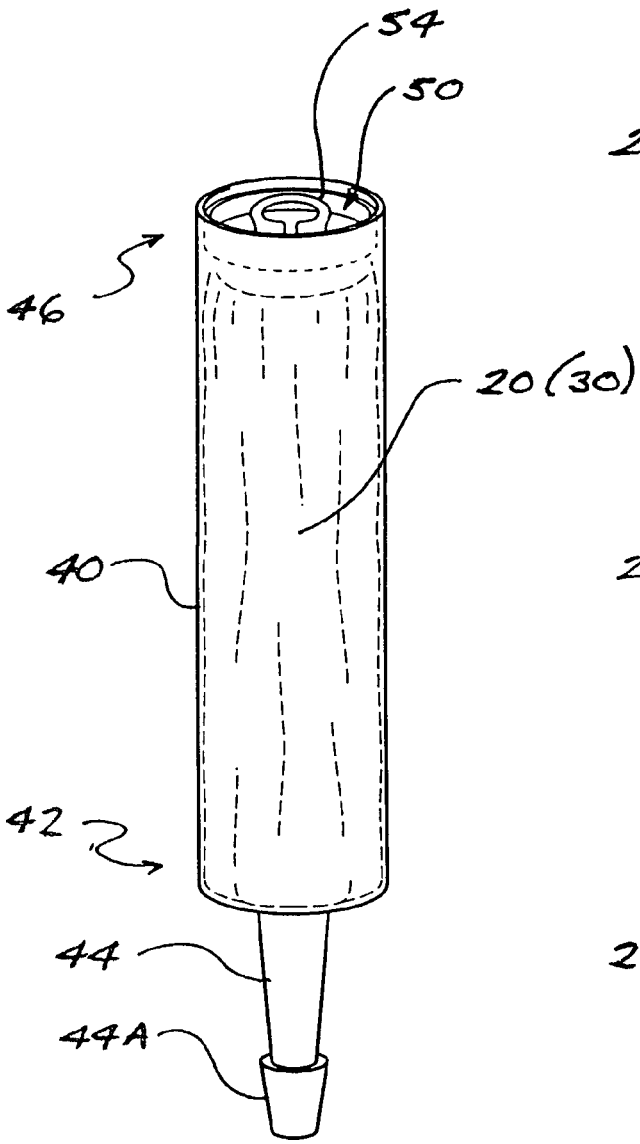
FIG. 2 is an assembled view of the caulking product of FIG. 1.

Caulking product 10 may be provided in the form of a kit of components, as shown in FIG. 2. However, in the preferred embodiment it is provided in assembled form as illustrated in FIG. 2, with casing 20 completely disposed within interior chamber 48 of cartridge 40, and with plug member 50 inserted into open end 46 of cartridge 40 so as to retain casing 20 within interior chamber 48. When casing 20 is thus disposed within interior chamber 48, unfilled portion 24 will be folded or otherwise bunched up against filled portion 22. In the preferred embodiment, casing 20 is disposed within interior chamber 48 with free end 22F of filled portion 22 disposed toward nozzle end 42, such that unfilled portion 24 will be adjacent to plug member 50.

Once assembled as described, caulking product 10 may be conveniently packaged for transport to retail or wholesale merchants for display and sale as desired, or for direct transport to a site where it is desired to use caulking product 10 to prepare coloured caulking. In order to use caulking product 10 for this purpose, and in accordance with the method of the present invention, the user first removes plug member 50 from open end 46 of cartridge 40. To facilitate this step, plug member 50 preferably has a gripping element 54. As illustrated in FIGS. 1 and 2, gripping element 54 may be in the form of a loop formed integrally with or attached to gripping element 54. In any case, after plug member 50 has been removed from cartridge 40, casing 20 is then withdrawn or otherwise removed from cartridge 40. This step is preferably facilitated by assembling the product with unfilled portion 24 of casing 20 adjacent to plug member 50 as previously described; the user may simply grasp and pull on the folded or bunched-up unfilled portion 24 in order to withdraw casing 20 from cartridge 40.

Figure 3:
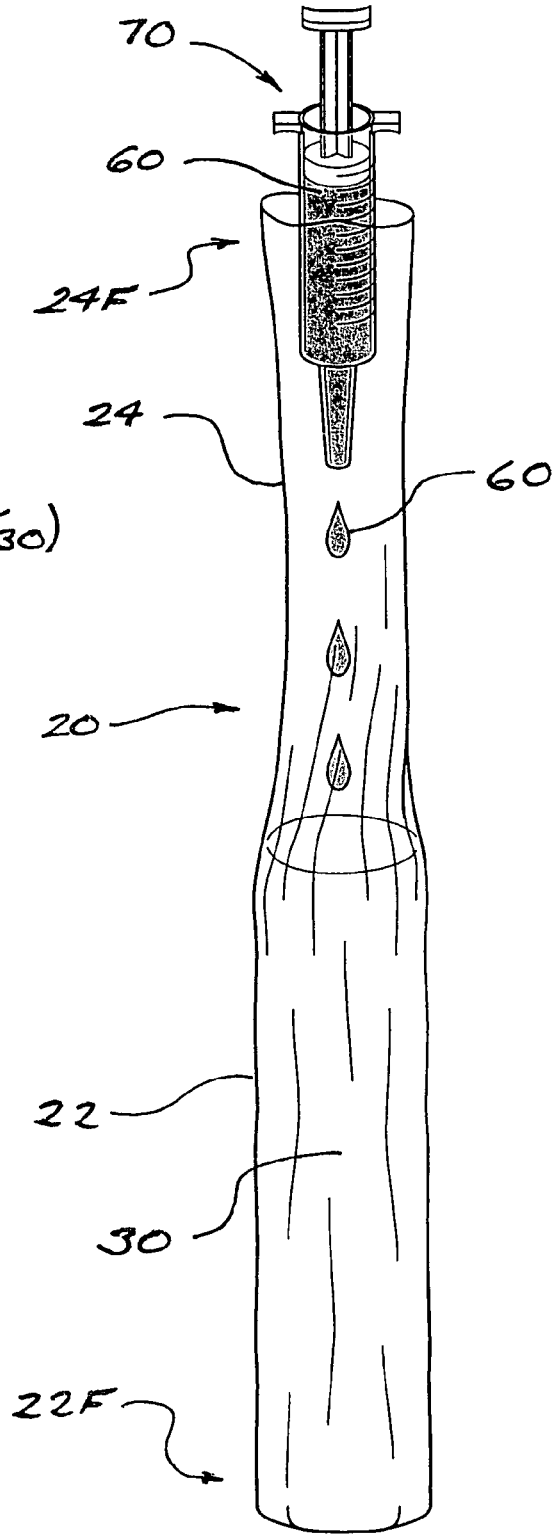
FIG. 3 illustrates the step of introducing a tinting agent into an unsealed caulking casing in accordance with one embodiment of the method of the invention.

The next step in the method is to unseal casing 20 and then to introduce a desired amount of tinting agent 60 thereinto. In the preferred embodiment of the method, as illustrated in FIG. 3, unfilled portion 24 of casing 20 is unsealed (preferably at or close to free end 24F) by any convenient means, such as by slitting it with a knife, cutting it with scissors, or forming a puncture with a suitable tool. A desired quantity or charge of a selected tinting agent 60 is then introduced into casing 20. In the particularly preferred embodiment shown in FIG. 3, tinting agent 60 is introduced using an inexpensive conventional syringe 70, the use of which helps to eliminate or reduce the chance of spillage of tinting agent. Where the desired tinting agent 60 is a paint (as will perhaps most often be the case) or other liquid, syringe 70 can be used to draw the liquid from its container and discharge it into casing 20, after which syringe 70 may simply be discarded. Syringe 70 thus facilitates the introduction of tinting agent 60 into casing 20 without the user having to come into contact with the liquid. However, any other convenient means for introducing tinting agent 60 into casing 20 may be used without departing from the present invention.

Figure 4:
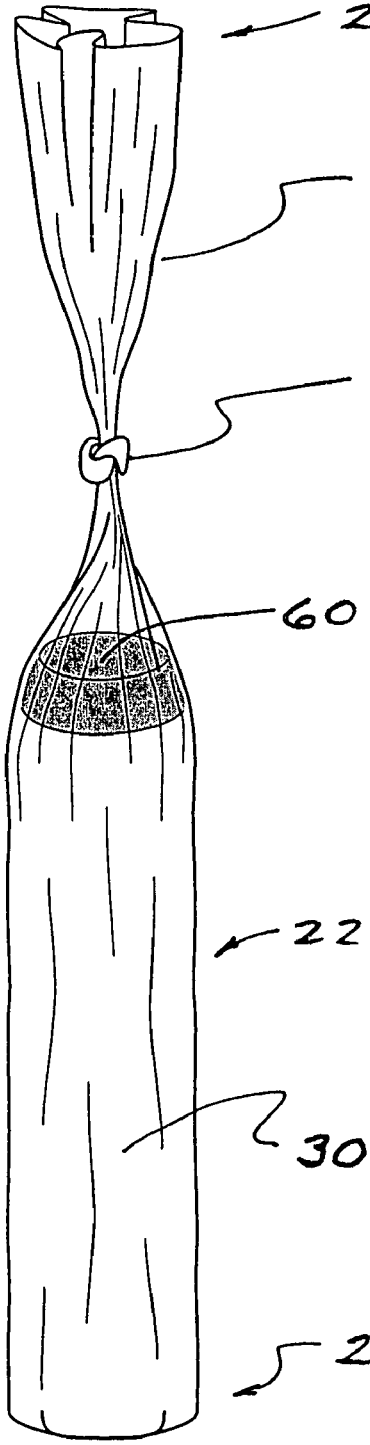
FIG. 4 illustrates the caulking casing after being resealed subsequent to the step shown in FIG. 3.

After tinting agent 60 has been introduced into casing 20, the next step is to seal the unsealed free end 24F of casing 20. As shown in FIG. 4, this may be conveniently accomplished by tying a knot 29 in unfilled portion 24 of casing 20. To facilitate this and other possible methods of resealing casing 20, unfilled portion 24 will preferably be approximately 4-6 inches (or 100-150 millimeters) in length; any undesired excess may be cut off after the knot 29 or other type of seal has been formed in unfilled portion 24. However, it is not essential for unfilled portion 24 to be of any particular size or length. What is important is for unfilled portion 24 is large enough to allow for introduction of a desired quantity of tinting agent into casing 20 (after it has been unsealed, as described below), and to allow casing 20 to then be resealed.

Figure 5:
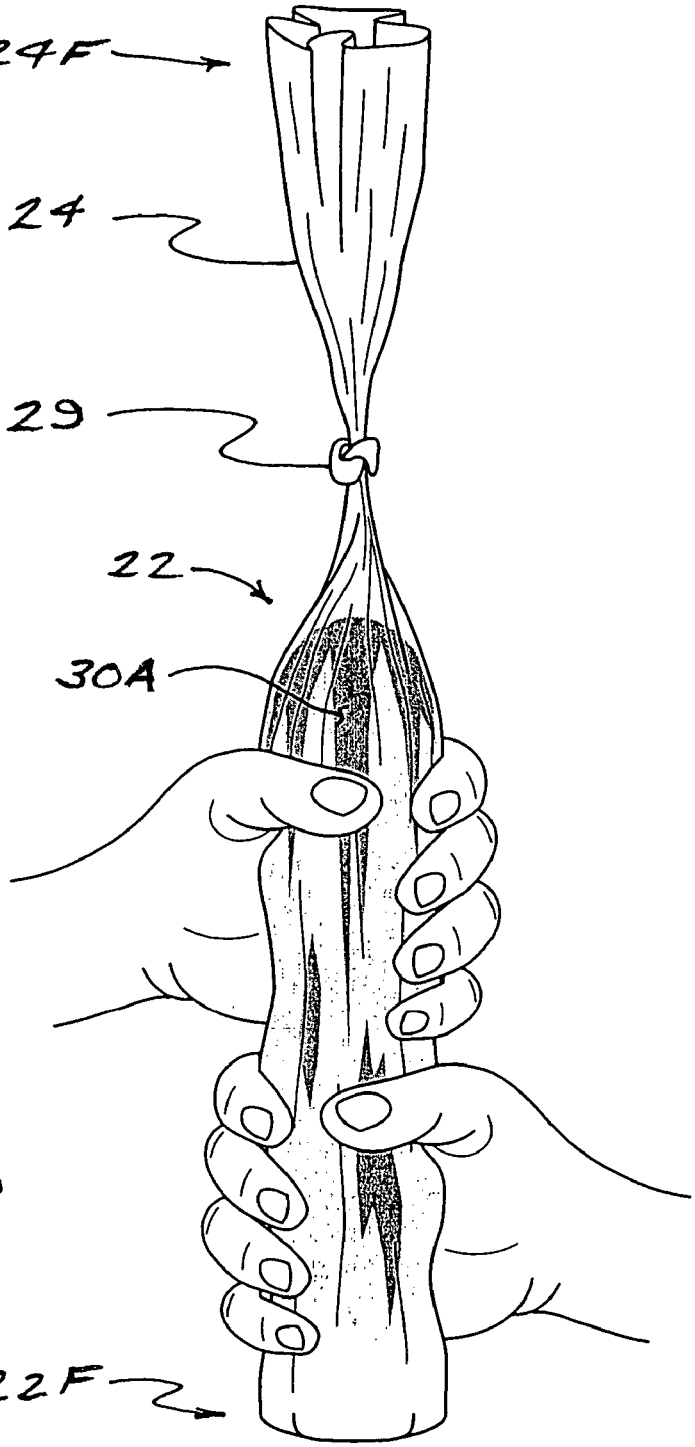
FIG. 5 conceptually illustrates the step of manually mixing the caulking and tinting agent after the casing has been resealed as shown in FIG. 4.

With casing 20 resealed as described, with caulking 30 and tinting agent 60 enclosed therein, the user manually kneads casing 20, as conceptually illustrated in FIG. 5, to combine tinting agent 60 with caulking 30 until they have become substantially uniformly mixed, with caulking 30 having acquired a substantially uniform colour. As used in this patent document, the term "knead" and its related forms are intended to denote and include kneading, rolling, squeezing, or other similar manipulative techniques (which may or may not involve the use of tools or accessories), or combinations of such methods.

The inventors have achieved satisfactory results after performing the kneading operation for as little as three minutes, using white acrylic caulking and a conventional acrylic paint as the tinting agent. These results have been achieved with the materials at room temperature, without need for pre-warming the caulking as may be desirable or necessary with some prior art methods and apparatus. The inventors have also found that as little as one ounce of latex paint will usually be sufficient to give the caulking a colour closely matching that of the paint (based on tinting caulking in an amount corresponding to a typical caulking cartridge sold in hardware stores and home improvement centers). However, other mixing times and other sizes of tinting charge may be effective or appropriate depending on the specific properties of the caulking to be tinted and the tinting agent to be used.

Figure 6:
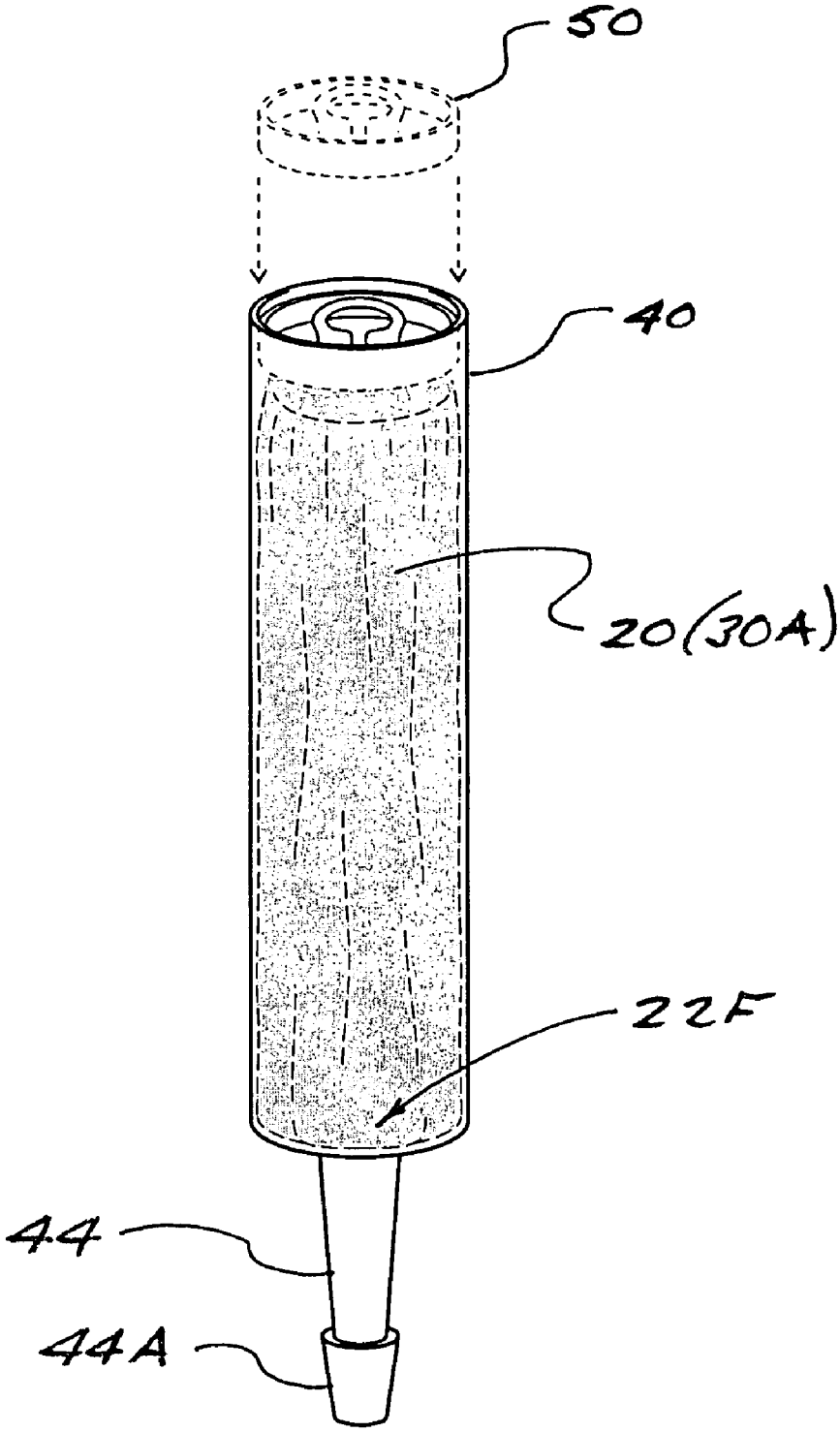
FIG. 6 illustrates the caulking casing after re-insertion into the cartridge after the manual mixing step illustrated in FIG. 5.

After the caulking has been mixed and tinted as described above, it is a simple matter to reinsert casing 20 (now containing tinted caulking 30A) into interior chamber 48 of cartridge 40, and to reinsert plug member 50 into open end 46 of cartridge 40 so as to retain casing 20 within interior chamber 48, all as illustrated in FIG. 6. The step of reinserting cartridge 40 will preferably be performed such that filled portion 22 of casing 20 is directed toward nozzle end 44 of cartridge 40.

If it is desired to apply tinted caulking 30A immediately, free end 22F of filled portion 22 may be unsealed (such as by being slit with a utility knife) before casing 20 is reinserted into cartridge 40. After casing 20 has thus been reinserted into cartridge 40 (with free end 22F of filled portion 22 unsealed, and with plug member 50 having been reinserted), cartridge 40 may be loaded into a suitable conventional caulking gun for use in accordance with known application methods. Actuation of the caulking gun causes plug member 50 to be urged against casing 20 so as to force tinted caulking 30A out of unsealed casing 20 and through cartridge nozzle 46.

If it is desired to delay the application of tinted caulking 30A, casing 20 may be reinserted into cartridge 40 in a sealed state, whereupon plug member 50 may be reinserted as well. This method is particularly convenient where it is desired to prepare tinted caulking at a location away from the site where it is to be applied. When it is subsequently desired to apply the tinted caulking 30A, it is a simple matter to remove plug member 50 and casing 20 from cartridge 40, unseal free end 22F of filled portion 22, reinsert casing 20 into cartridge 40 (with free end 22F disposed toward nozzle end 44 of cartridge 40), and reinsert plug member 50. Cartridge 40, with tinted caulking 30A contained therein, is now ready for loading in a caulking gun for application as desired.

It will be readily appreciated by those skilled in the art that various modifications of the present invention may be devised without departing from the essential concept of the invention, and all such modifications are intended to be included in the scope of the claims appended hereto.

In this patent document, the word "comprising" is used in its non-limiting sense to mean that items following that word are included, but items not specifically mentioned are not excluded. A reference to an element by the indefinite article "a" does not exclude the possibility that more than one of the element is present, unless the context clearly requires that there be one and only one such element.

What is claimed is:

1. A method for preparing a cartridge of tinted caulking, said method comprising the steps of:

(a) providing an elongate cylindrical cartridge having a nozzle end, an open end, and an interior chamber with a cylindrical wall;

(b) providing a quantity of caulking scalingly enclosed in and partially filling an elongate, pliable casing, at least a portion of said casing being transparent;

(c) providing a plug member having a circular perimeter edge, said plug member being movable longitudinally within the interior chamber of the cartridge with said perimeter edge in sliding engagement with the cylindrical wall of the cartridge;

(d) unsealing one end of the casing;

(e) introducing a quantity of tinting agent into the casing, said tinting agent being miscible with the caulking;

(f) resealing the unsealed end of the casing;

(g) kneading the caulking and tinting agent within the casing until the caulking is of a substantially uniformly colour;

(h) unsealing one end of the casing, and inserting the casing, unsealed end first, into the open end of the cartridge; and (i) inserting the plug member into the open end of the cartridge.

2. The method of claim 1 wherein the caulking is a latex-based caulking and the tinting agent is a latex-based paint.

3. The method of claim 1 wherein the casing is made of a plastic film.

4. The method of claim 1 wherein the tinting agent is in liquid form, and wherein the step of introducing tinting agent into the casing is carried out by drawing the tinting agent into a syringe and then discharging the tinting agent from the syringe into the casing.

5. The, method of claim 1 wherein the caulking fills only part of the casing and is disposed toward one end thereof, thus dividing the casing into a filled portion having a free end and an unfilled portion having a free end.

6. The method of claim 5 wherein the step of unsealing one end of the casing is carried out by unsealing the free end of the unfilled portion of the casing, and wherein the step of resealing the unsealed end of the casing is carried out by tying a knot in the unfilled portion of the casing.

* * * * *